United States Patent [19]

Becker et al.

[11] Patent Number: 4,953,722

[45] Date of Patent: Sep. 4, 1990

[54] CRANE AND LIFT ENHANCING BEAM ATTACHMENT WITH MOVEABLE COUNTERWEIGHT

[75] Inventors: Thomas K. Becker, Manitowoc; Terry S. Casavant, Two Rivers; P. Ralph Helm, Manitowoc; Terry L. Petzold, Kiel; Michael J. Wanek, Two Rivers; Art G Zuehlke, Manitowoc, all of Wis.

[73] Assignee: The Manitowoc Company, Inc., Manitowoc, Wis.

[21] Appl. No.: 269,222

[22] Filed: Nov. 9, 1988

[51] Int. Cl.[5] ..... B66C 23/76

[52] U.S. Cl. ..... 212/156; 212/178; 212/187; 212/196; 212/197

[58] Field of Search ..... 212/178, 195, 196, 197, 212/198, 186, 182, 156, 175

[56] References Cited

U.S. PATENT DOCUMENTS

| | | | |
|---|---|---|---|
| 524,619 | 8/1894 | Sturm . | |
| 752,948 | 2/1904 | Nickerson . | |
| 970,773 | 9/1910 | Wylie . | |
| 2,986,407 | 5/1961 | Krueger | 212/198 |

(List continued on next page.)

FOREIGN PATENT DOCUMENTS

| | | | |
|---|---|---|---|
| 668394 | 8/1963 | Canada . | |
| 687051 | 5/1964 | Canada . | |
| 767482 | 9/1967 | Canada . | |
| 827499 | 11/1969 | Canada . | |
| 900414 | 5/1972 | Canada . | |
| 997748 | 9/1976 | Canada . | |
| 1002509 | 12/1976 | Canada . | |
| 1013299 | 7/1977 | Canada . | |
| 1026715 | 2/1978 | Canada . | |
| 1033688 | 6/1978 | Canada . | |
| 1114334 | 12/1981 | Canada . | |
| 1125191 | 6/1982 | Canada . | |
| 1201426 | 3/1986 | Canada . | |
| 1237698 | 6/1988 | Canada . | |
| 0048076 | 3/1982 | European Pat. Off. . | |
| 2018819 | 11/1970 | Fed. Rep. of Germany | 212/195 |
| 33410496 | 5/1985 | Fed. Rep. of Germany . | |
| 3427689.0 | 7/1985 | Fed. Rep. of Germany . | |
| 3515607.4 | 12/1985 | Fed. Rep. of Germany . | |
| 8422345.6 | 12/1985 | Fed. Rep. of Germany . | |
| 1176745 | 4/1959 | France . | |
| 2195579 | 3/1974 | France . | |
| 2235868 | 1/1975 | France . | |
| 2436098 | 4/1980 | France . | |
| 48-27820 | 8/1973 | Japan . | |
| 50-7653 | 3/1975 | Japan . | |
| 51-6430 | 2/1976 | Japan . | |
| 54-10141 | 5/1979 | Japan . | |
| 55-145993 | 11/1980 | Japan . | |
| 58-170387 | 11/1983 | Japan . | |
| 58437 | 5/1946 | Netherlands . | |
| 228244 | 5/1969 | U.S.S.R. | 212/195 |
| 957450 | 6/1962 | United Kingdom . | |
| 1548555 | 1/1978 | United Kingdom . | |
| 2026409 | 7/1979 | United Kingdom . | |
| 2140772A | 12/1984 | United Kingdom . | |

*Primary Examiner*—Sherman D. Basinger
*Assistant Examiner*—Thomas J. Brahan
*Attorney, Agent, or Firm*—Willian Brinks Olds Hofer Gilson & Lione

[57] ABSTRACT

A crane and an attachment comprising a counterweight support beam including a plurality of connected segments movable relative to each other, and having a fore end adapted to be connected to the crane upper works, and an aft end rearward from the rear portion of the upper works. The attachment also includes a moveable counterweight carrier adapted to carry a counterweight when the counterweight is supported thereon. The carrier is mounted on the support beam for movement along the length thereof. The attachment also includes a cylinder for selectively moving the counterweight carrier fore and aft along the beam, landing gear for normally supporting the aft end of the beam on the ground, and a backhitch pendant and a pendant cylinder interconnecting the aft end of the beam and the top of the mast for raising the landing gear from the ground incident to lifting a heavy load from the boom. The support beam is extendable by moving the connected segments relative to each other between a first position, wherein the aft end is spaced from the rear portion of the crane upper works, and a second position, wherein the aft end is spaced further from the rear portion of the crane upper works.

37 Claims, 7 Drawing Sheets

U.S. PATENT DOCUMENTS

| | | | |
|---|---|---|---|
| 3,037,643 | 6/1962 | Hermann . | |
| 3,202,299 | 8/1965 | Decuir . | |
| 3,209,920 | 10/1965 | Decuir . | |
| 3,435,961 | 4/1969 | Hamson | 212/49 |
| 3,485,383 | 12/1969 | Beduhn . | |
| 3,836,010 | 9/1974 | Lampson . | |
| 3,842,984 | 10/1974 | Brown et al. . | |
| 3,878,944 | 4/1975 | Beduhn et al. . | |
| 3,921,815 | 11/1975 | Brown et al. . | |
| 3,930,583 | 1/1976 | Jouffray . | |
| 4,042,115 | 8/1977 | Beduhn et al. . | |
| 4,103,783 | 8/1978 | Beduhn et al. . | |
| 4,168,781 | 9/1979 | Bryan, Jr. . | |
| 4,169,535 | 10/1979 | Bryan, Jr. . | |
| 4,170,309 | 10/1979 | Lampson . | |
| 4,172,529 | 10/1979 | Bryan, Jr. . | |
| 4,196,816 | 4/1980 | Dvorsky et al. . | |
| 4,204,664 | 5/1980 | Bryan, Jr. . | |
| 4,243,148 | 1/1981 | Lampson . | |
| 4,258,852 | 3/1981 | Juergens | 212/178 |
| 4,280,627 | 7/1981 | Becker | 212/198 |
| 4,286,720 | 9/1981 | Atkinson . | |
| 4,316,548 | 2/1982 | Helm et al. . | |
| 4,358,021 | 11/1982 | Helm et al. . | |
| 4,387,813 | 6/1983 | Beduhn et al. . | |
| 4,387,814 | 6/1983 | Beduhn et al. . | |
| 4,431,363 | 2/1984 | Waite . | |
| 4,449,635 | 5/1984 | Helm et al. . | |
| 4,508,232 | 4/1985 | Lampson | 212/198 |
| 4,537,317 | 8/1985 | Jensen . | |
| 4,540,097 | 9/1985 | Wadsworth et al. | 212/198 |
| 4,557,390 | 12/1985 | Mick | 212/197 |
| 4,601,402 | 7/1986 | Helm et al. . | |
| 4,614,275 | 9/1986 | Zenno | 212/195 |
| 4,679,336 | 7/1987 | Brocklebank et al. . | |
| 4,729,486 | 3/1988 | Petzold et al. | 212/189 |
| 4,773,814 | 9/1988 | Brocklebank et al. . | |

CRANE AND LIFT ENHANCING BEAM ATTACHMENT WITH MOVEABLE COUNTERWEIGHT

FIELD OF THE INVENTION

This invention relates to lift cranes and, more particularly, relates to lift enhancing attachments for mobile lift cranes.

BACKGROUND OF THE INVENTION

Conventional lift cranes include a rotatable body or upper works which supports a lift boom and lift machinery. The upper works rotates about a vertical axis on a lower works or base. If the crane is mobile, the lower works is typically crawler mounted. The lifting capacity of a mobile crane is largely determined by the geometry of the base, since all the compression and tilting loads must act through and around the mobile base to the ground. Larger cranes have been provided with increasing amounts of counterweight carried on the rotatable upper works to resist the overturning moment of the larger loads.

Earlier efforts to provide a lift enhancing beam attachment for lift cranes include U.S. Hamson Patent U.S. Pat. No. 3,435,961 issued Apr. 1, 1969, U.S. Juergens Patent U.S. Pat. No. 4,258,852 issued Mar. 31, 1981, and U.S. Petzold et al. Patent U.S. Pat. No. 4,729,486 issued Mar. 8, 1988. In the Juergens Patent, an auxiliary counterweight arrangement is provided consisting of a V-shaped attachment including two weight carriers at the end of carrier arms. The carrier arms are comprised of connected modular units. The number of units can be increased or decreased to lengthen or shorten the carrier arms, thereby increasing or decreasing the moment arm of the counterweight carriers attached to the end of the arms. Auxiliary counterweights are provided on the counterweight carriers at the ends of the arms, and are used in addition to the counterweights mounted on the crane upper works.

U.S. Petzold et al. Patent discloses an attachment for increasing the lifting capacity of a crane. The attachment comprises a support beam of fixed length. A counterweight assembly including a moveable carrier is mounted on the support beam, and means is provided for moving the carrier along the beam. A reference is also made, at column 4, lines 29 through 35, to sensor means "provided for indicating when a support leg is lifted from the ground and a suitable signal transmitted to the operator's cab", and a load indicator "incorporated in the crane and utilized for positioning the counterweight on the beam in accordance with the load being lifted".

Both of these patents are generally directed to attachments for larger cranes, and are not intended to provide a versatile crane attachment for use with smaller sized cranes.

U.S. Hamson Patent discloses a crane including a counterweight slidably mounted on a crane upper works, extendable outwardly opposite a boom, and doubled-ended means for extending and retracting the counterweight.

Attention is also directed to Russian Patent No. 214,777.

SUMMARY OF THE INVENTION

Disclosed is an attachment for increasing the lifting capacity of a crane. The crane includes a counterweight, a mobile lower works, and an upper works. The upper works is rotatably mounted on the lower works and includes a rear portion adapted to support the counterweight, a pivotally mounted boom having a top, an upwardly and rearwardly projecting mast having a top, means for lifting a load from the top of the boom, means interconnecting the top of the boom and the top of the mast, and means interconnecting the top of the mast and the rear portion of the upper works for opposing a load lifted from the top of the boom.

The attachment comprises a counterweight support beam including a plurality of connected segments movable relative to each other, and having a fore end adapted to be connected to the crane upper works, and an aft end rearward from the rear portion of the upper works. The attachment also includes a moveable counterweight carrier adapted to carry the counterweight when the counterweight is supported thereon. The carrier is mounted on the support beam for movement along the length thereof. The attachment also includes means for selectively moving the counterweight carrier fore and aft along the beam, leg means for normally supporting the aft end of the beam on the ground, means interconnecting the aft end of the beam and the top of the mast, and means for raising the leg means from the ground incident to lifting a heavy load from the boom. The support beam is extendable by moving the connected segments relative to each other between a first position, wherein the aft end is spaced from the rear portion of the crane upper works, and a second position, wherein the aft end is spaced further from the rear portion of the crane upper works.

In one embodiment, the connected segments comprise two spaced, parallel members, each including a plurality of telescopic segments. The support beam has a upper surface, and the carrier is supported by the support beam upper surface. Some of the plurality of telescopic segments are stepped so that, when the plurality of telescopic segments are fully extended, the upper surface of the support beam is essentially flat. The carrier can then be moved relatively easily along the flat support upper surface by the carrier moving means.

In one embodiment, the attachment further includes means for selectively extending and retracting the support beam.

In one embodiment, the means for moving the counterweight carrier comprises a hydraulic cylinder connected at one end to the fore end of the beam and at the other end to the carrier, and the extending and retracting means comprises the carrier moving means, and the carrier moving means is selectively attachable to the support beam aft end.

Also disclosed is means for sensing when the counterweight carrier supporting the counterweight has moved from the beam aft end to a position where the moment produced by the counterweight about equals the moment produced by the load, and for operating the leg raising means in response to the sensed position.

One of the principal features of the invention is the provision of a self-contained attachment for increasing the lifting capacity of a crane, the attachment being extendable to different lengths so as to provide an adjustable amount of increased lifting capacity for the crane, and so as to vary the rearward extension of the attachment as the amount of clearance around the crane varies so the crane may rotate easily when moving a load.

Another of the principal features of the invention is the provision of such an attachment which is fairly compact and relatively light and which is easily moveable from location to location.

Another of the principal features of the invention is the provision of such an attachment which may or may not be used with the crane as the operator so chooses, and which is easily attachable and detachable to the crane.

Another of the principal features of the invention is the provision of such an attachment which may be stowed within the crane upper works when so desired.

Other features and advantages of embodiments of the invention will become known by reference to the following drawings, general description and appended claims.

BRIEF DESCRIPTION OF THE DRAWINGS

FIG. 4 is a side elevation view of an extended support beam of the attachment before the connected beam segments are pinned in place.

Figure 1:
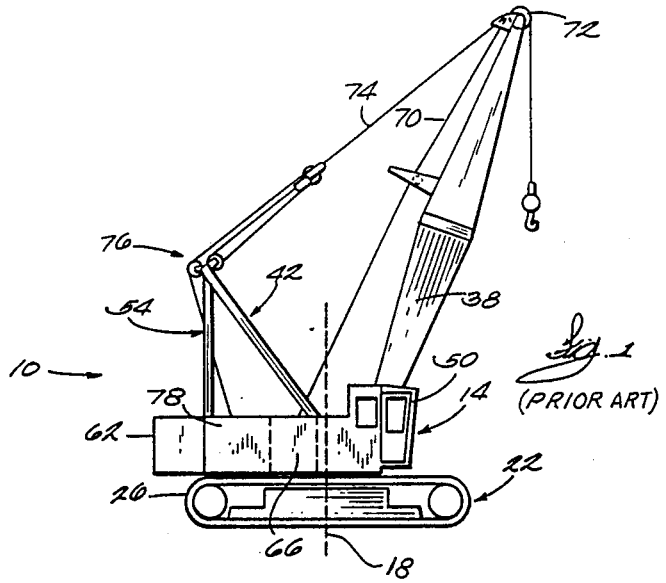
Fig. 1 (PRIOR ART)
FIG. 1 is a side view of a crane.

Before explaining at least one embodiment of the invention in detail, it is to be understood that the invention is not limited in its application to the details of construction and the arrangement of components set forth in the following description or illustrated in the drawings. The invention is capable of other embodiments and of being practiced or carried out in various ways. Also, it is to be understood that the terminology employed herein is for the purposes of description, and should not be regarded as limiting.

DESCRIPTION OF THE PREFERRED EMBODIMENT

FIG. 1 illustrates a conventional crane 10. The crane 10 has an upper works 14 mounted for rotation about a vertical axis 18 on a mobile lower works 22 having, in this embodiment, self-propelled crawler tracks 26. The crane upper works 14 includes a turntable bearing (not shown) connected in conventional fashion to a displacement motor (not shown) for 360° swinging movement on the lower works 22. The upper works 14 also includes a pivotally mounted boom 38 at the fore end thereof, an upwardly and rearwardly projecting pivotally mounted mast or gantry 42, and an operator's cab 50. In the illustrated embodiment, the mast 42 is held in a rearwardly inclined position by a generally rigid backhitch 54, which also connects the top of the mast 42 to the rear of the upper works 14.

The back or rear portion of the crane upper works 14 is adapted to support a counterweight 62. The counterweight 62 is pinned to the rear portion of the upper works 14 by two vertically spaced brackets (not shown) on the face of the counterweight 62.

In order to lift a load, means 66 for lifting a load from the top of the boom is provided. As illustrated in FIG. 1, the load lifting means 66 includes a lift line 70 (which may include multiple parts of the line) trained over a sheave assembly 72 at the top of the boom 38. The lift line 70 is drawn in or paid out by one or more drums (not shown) forming part of the power lift machinery. To adjust the boom angle, live rigging 74 connected to the top of the boom 38 is trained over a sheave assembly 76 at the top of the mast 42, and is drawn in or paid out by a boom hoist winch and gantry assembly 78 mounted on the rear portion of the crane upper works 14. The crane 10 thus far described is sold commercially by the Manitowoc Engineering Company as its model M-80W crawler mounted crane.

In its normal mobile lift crane configuration, the crane 10 as just described is provided with the counterweight 62 attached to the rear portion of the crane upper works 14. The counterweight 62 comprises either a single unit or a plurality of connected counterweight units or boxes. It is understood that the forward tipping moment imposed on the crane 10 by a heavy load connected to the lift line 70 is carried back from the boom top through the live rigging 74 to the mast top and down through the backhitch 54 to the rear portion of the upper works 14 which supports the counterweight 62.

Figure 5:
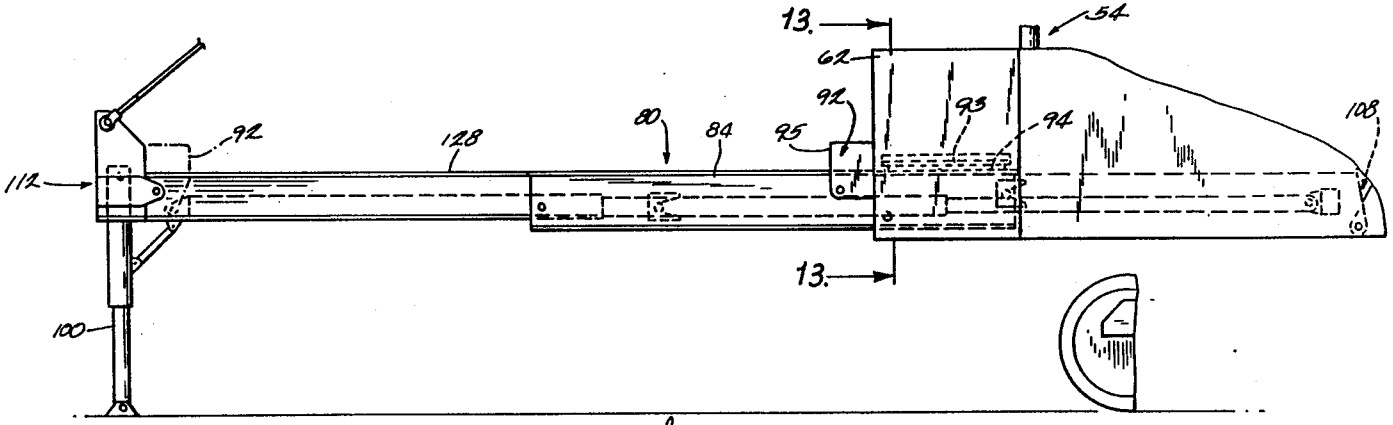
FIG. 5 is a side elevation view of the attachment in its fully extended position, and connection of the attachment's counterweight carrier to the counterweight.
Figure 12:
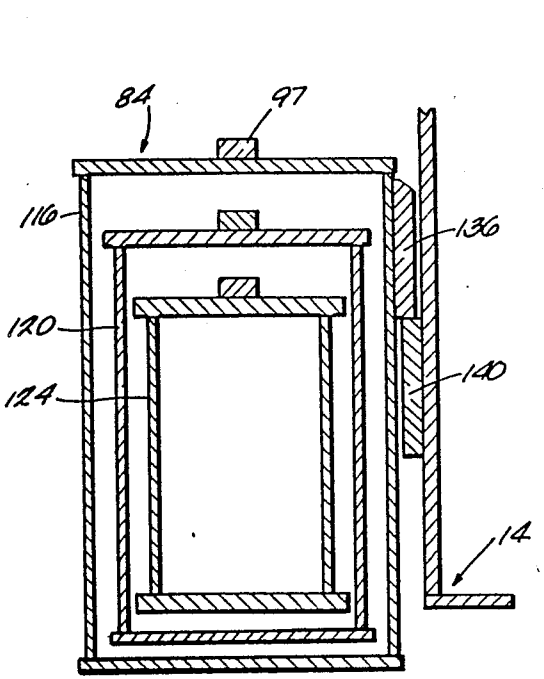
FIG. 12 is a cross-sectional view of one of the two spaced, parallel telescoping members making up the support beam of the attachment taken along the line 12—12 in FIG. 9.
Figure 13:
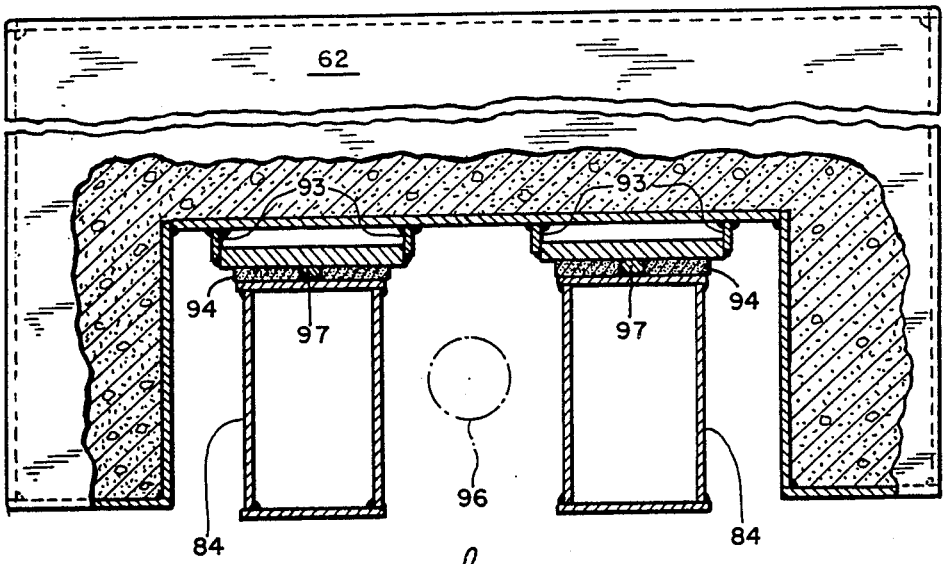
FIG. 13 is a cross-sectional view taken along line 13—13 in FIG. 5.

A lift enhancing beam attachment 80 is illustrated in FIGS. 2 through 12. Referring more specifically to FIG. 4, the attachment 80 comprises a counterweight support beam 84 comprising two spaced, parallel members (see FIG. 10), only one of which is visible in FIGS. 2–6, 8–9 and 11, each including a plurality of connected segments 88 movable relative to each other, and a moveable counterweight carrier 92 adapted to carry the counterweight 62 when the counterweight 62 is supported thereon. As illustrated in FIGS. 5 and 13, the counterweight carrier 92 is preferrably comprised of a first piece 93 in the, form of vertical plates attached to the central bottom surface of the counterweight 62 on both sides of the beam and a second piece 95 detachably connected to the counterweight 62. The counterweight 62 is slidably mounted on the beam 84 by another portion of the carrier 92 which comprises wear pads 94 made of some low friction wear metalic or non-metalic material. In the preferred embodiment, the wear pads 94 are made of the cast polyamide. In other embodiments, rollers may be substituted for the wear pads 94.

In either embodiment, the wear pads 94 of rollers are fixed to the vertical plates 93. In the preferred embodiment, where the attachment comprises two spaced, parallel telescoping members, there are two sets of plates 93 and wear pads 94, each set centered over one of the telescoping members, and each set having spaced wear pads that fit on opposite sides of guide track 97 (see FIG. 13).

Figure 6:
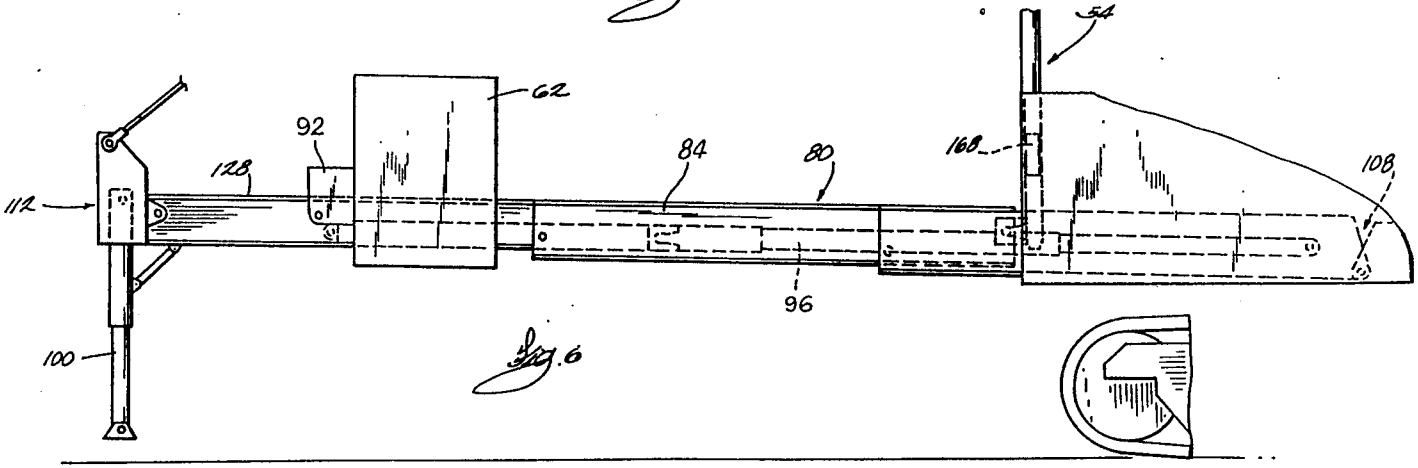
FIG. 6 is a side elevation view of the attachment after the counterweight has been moved along the attachment to the full aft end of the support beam, load lifted, and then moved back to where a load sensor has indicated that the counterweight has moved past a counterweight load balance position, and the rearward or aft end of the attachment has been raised to provide ground clearance for travel or swing.

Referring to FIG. 6, the attachment 80 also includes means 96 for selectively moving the counterweight carrier 92 fore and aft along the beam 84, leg means in the form of lift jacks or landing gear 100 for normally supporting the aft end of the beam 84 on the ground, and means 104 (FIG. 4)interconnecting the aft end of the beam 84 and the top of the mast 42 for raising the landing gear 100 from the ground incident to lifting a heavy load from the boom 38.

Referring now more particularly to the support beam 84, the support beam has a fore end 108 adapted to be detachably pivotally connected to the crane upper works 14, and an aft end 112 rearward from the rear portion of the upper works 14. The beam 84 is extendable by moving the plurality of connected segments 88 relative to each other between a first position, wherein the aft end 112 is spaced from the rear portion of the crane upper works 14, and a second position wherein the aft end 112 is spaced further from the rear portion of the crane upper works 14.

Figure 2:
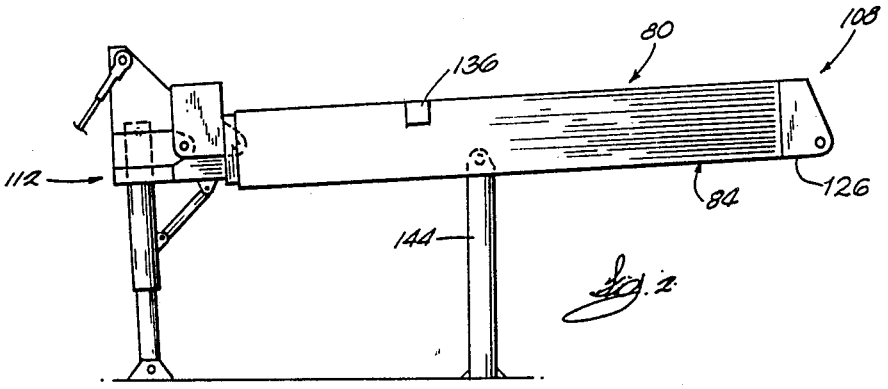
FIG. 2 is a side elevation view of an attachment, which embodies various features of the invention, prior to being connected to the crane.
Figure 3:
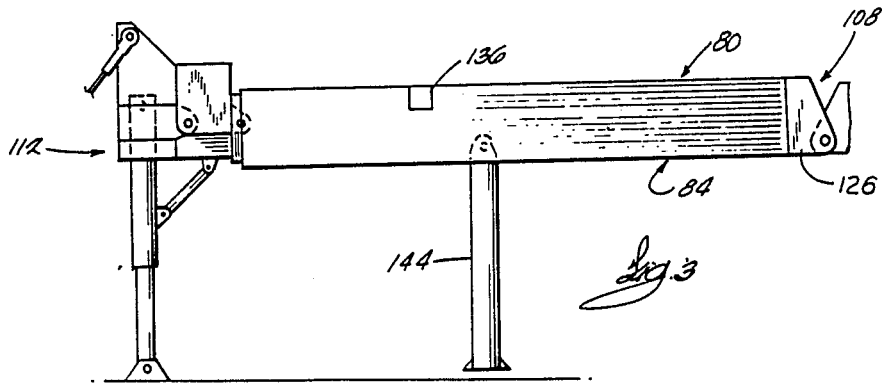
FIG. 3 is a side elevation view of the attachment as it appears when connected to the crane upper works with its fore end raised.
Figure 1:
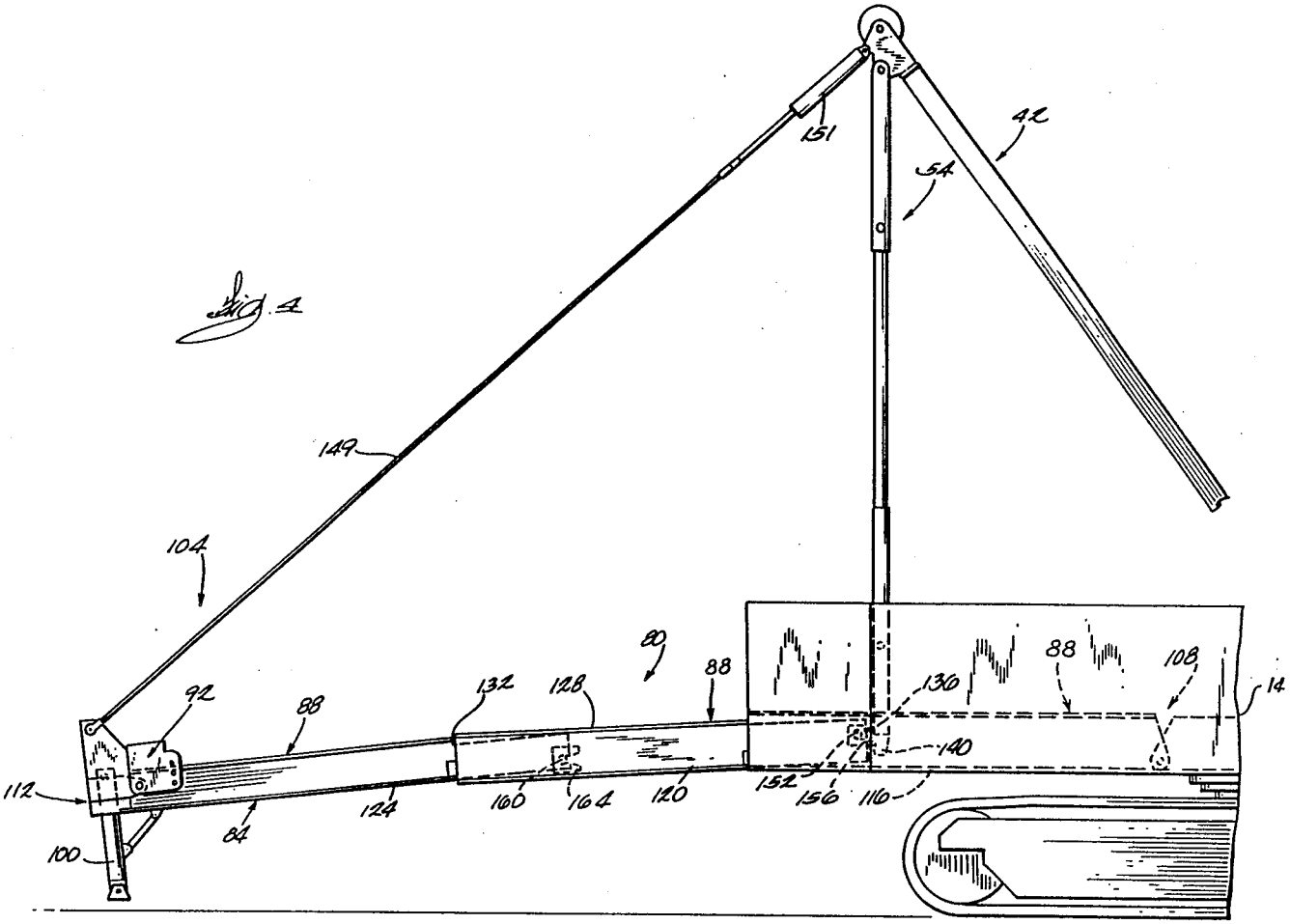
Figure 10:
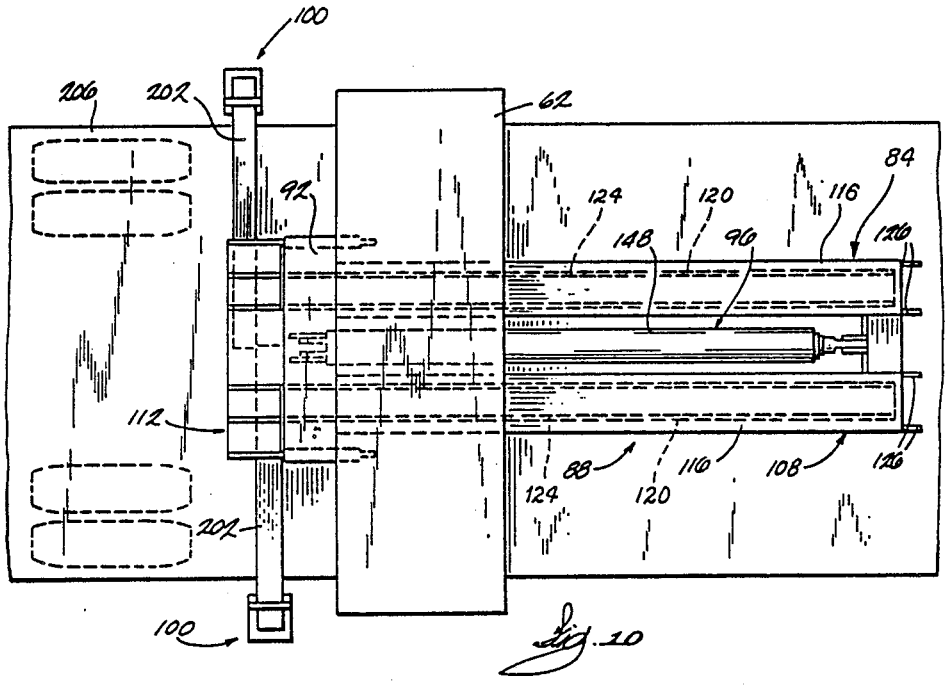
FIG. 10 is a top view of the attachment and the counterweight mounted on a trailer bed for transport of the attachment and the counterweight to another location.

Although other constructions could, be used in other embodiments, each of the two parallel members of the support beam 84 comprise three telescopic segments 116, 120 and 124. More particularly, as illustrated in FIG. 12, the second telescopic segment 120 is received within the first segment 116, and the third telescopic segment 124 is received within the second segment 120. Although other constructions can be used in other embodiments, in this embodiment, the support beam segments 88 are parallel connected pieces of a generally open box like section made of welded steel plate (see FIG. 12). The outermost or first segment 116 of the three telescopic segments 88 is adapted to be pivotally connected to the crane upper works 14 at a point within the upper works 14 and just behind the center of rotation IB of the crane upper works 14. The connected pieces of the first segment 116 are adapted to be connected to the crane upper works by support brackets 126 on the fore end thereof(FIGS. 2, 3 and 10). Further, the spaced apart lift jacks forming the landing gear 100 are each connected by staggered outriggers 202 to the aft end 112 of the third segment 124 of each of the two spaced, parallel members of the supported beam 84 (FIG. 10).

In this embodiment, the means 96 for selectively moving the counterweight carrier 92 fore and aft along the beam 84 is in the form of a hydraulic cylinder 96 connected at one end to the beam fore end 108 and at the other end to the carrier 92. The attachment 80 also includes support beam extending and retracting means. In this embodiment, the support beam extending and retracting means is the carrier moving means 96, and the carrier cylinder 96 is selectively attachable through the carrier 92 to the support beam aft end.

As illustrated in FIG. 4, the support beam 84 has an upper surface 128, and the carrier 92 is supported by the support beam upper surface 128. The second and third of the three telescopic segments are stepped (see, for example, the step 132 in FIG. 4) so that, when the three telescopic segments 88 are fully extended, the support beam upper surface 128 is essentially flat, as illustrated, for example, in FIG. 5. Since the upper surface 128 is relatively smooth or flat, the carrier 92 can be moved relatively easily along the support beam upper surface 128 by the carrier moving means 96.

As illustrated in FIG. 2, the support beam 84 is further adapted to be connected to the crane upper works 14 intermediate the fore and aft ends thereof by intermediate support shear blocks 136 on the outward facing side of the first segment 116 of both parallel members of the support beam 84. The support shear blocks 136 are held by hanger shear blocks 140 within the crane upper works 14, as hereinafter described.

In order to position the attachment 80 for connection of the attachment 80 to the crane upper works 14, the attachment 80 further includes pivot support means intermediate the support beam fore end 108 and the support beam aft end 112 for selectively providing additional support of the beam 84 on the ground. More particularly, the pivot support means is in the form of pivot beams 144 (only one of which is shown) pivotally connected intermediate the fore and aft ends of the beam first segment pieces. The pivot beams 144 can either be locked in an up position, where it is substantially parallel to the first beam segment 116, or placed in a down position. When the pivot beams 144 are in the down position, the attachment 80 can be pivoted about the top of the pivot beams 144 to obtain proper pin alignment.

As illustrated in FIG. 2, the attachment 80 is positioned for connection to the crane upper works 14 by adjusting the landing gear 100 which supports the aft end of the beam 84. The landing gear 100 is extendable or retractable, in this embodiment, by a hand crank (not shown). When located in the position shown in FIG. 2, the crane 10 can be backed up to where the beam fore end 108 is at a point just behind the rotational axis of the crane upper works 14. The fore end of the first segment 116 is then pinned to the crane upper works 14, and the support shear blocks are now located above the hanger shear blocks. Sufficient space is provided in the crane upper works 14 in order to receive the crane attachment 80. Thus, the attachment 80 is supported by the crane upper works 14 at two points on each side, one point being the beam fore end 108 pivotally attached to the crane upper works, and the second point being at the support shear blocks 136.

Referring again to FIG. 4, the means interconnecting the beam aft end 112 and the top of the mast 42 comprises a backhitch pendant 149 adapted to be connected to one of the beam aft end 112 and the top of the mast 42. The means for raising the landing gear 100 from the ground incident to lifting a heavy load from the boom 38 comprises a hydraulic cylinder 151 connected to the backhitch pendant 149 and the other of the support beam aft end 112 and the top of the mast 42. In the preferred embodiment, the backhitch pendant 149 consists of a plurality of segments, and the backhitch cylinder 151 is connected to the top of the mast 42, and the backhitch pendant 149 is connected to the beam aft end 112. In other, although less preferred embodiments, the hydraulic cylinder 151 can be omitted, and the landing gear 100 may be raised by retracting the landing gear, or by mast articulation.

Figure 9:
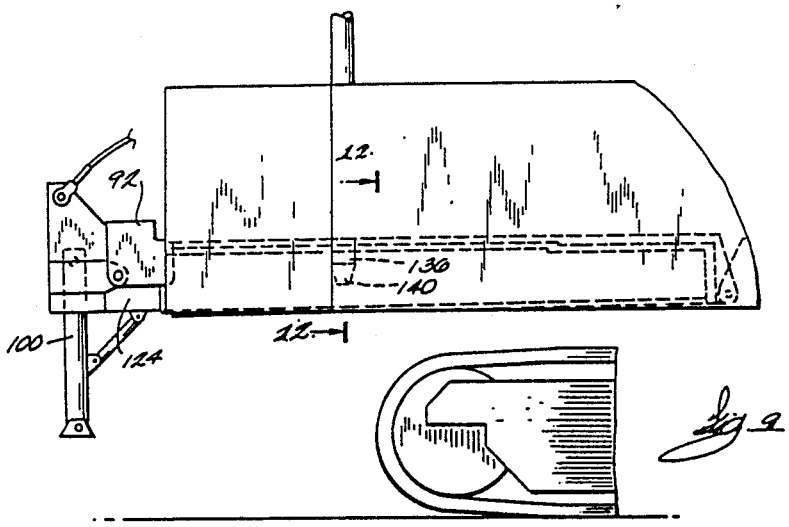
FIG. 9 is a side elevational view of the crane with the attachment in a fully retracted storage position.

In order to extend the support beam telescopic segments 88 when the support beam 84 is in its retracted position, as illustrated in FIG. 9, the landing gear 100 is placed in its fully retracted (stored) position, and the counterweight carrier 92 is attached to the aft end of the innermost or third support beam segment 124. The carrier cylinder 96 is then fully extended, as illustrated in FIG. 4, thereby fully extending all the support beam segments 88. The backhitch cylinder 151 must be fully extended as the support beam segments 88 are being extended in order to maintain slack in the backhitch pendant 149. Means is also provided for stopping the connected segments 88 in their fully extended positions. More particularly, the stopping means includes pins 152 (shown for only one of the two spaced, parallel members of the support beam 84) which extend outwardly from the second segment 120, and V-shaped brackets 156 (only one is shown) mounted on the inside of the first segment 116. As the second segment 120 is moved relative to the first segment 116, the V-shaped brackets 156 catch the pins 152, thereby limiting any further travel of the second segment 120. Further, in like manner, as the third segment 124 is moved rearward, pins 160 extending outwardly from the third segment 124 are trapped by V-shaped brackets 164 mounted on the inside of the second segment 120 to limit any further extension of the third segment 124.

The segments 88 are then pinned together. In order to align openings (not shown) in the segments 88 and to pin the segments 88 to each other, the backhitch cylinder 151 is retracted while the carrier cylinder 96 holds the segments 88 in their fully extended position.

The backhitch cylinder 151 is then adjusted to level the support beam 84 (see FIG. 5), and the landing gear 100 is extended to its operating length where it meets the ground. The carrier 92 is then detached from the beam aft end 112, and the carrier cylinder 96 is retracted to where the carrier second piece 95 is adjacent the counterweight 62. The carrier second piece 95 is then pinned to the counterweight 62, and the counterweight 62 is detached from the crane upper works 14. The backhitch cylinder 151 can be retracted slightly to help disengage the counterWeight 62 from the crane upper Works 14, if necessary. The attachment 80 is now ready for operation. The backhitch cylinder 151 is retracted so that the landing gear 100 is lifted off the ground (see FIG. 6). The crane is positioned to lift the load. The backhitch cylinder 151 is extended to set the landing gear 100 on the ground, and the carrier cylinder 96 is extended in order to move the counterweight 62 to the beam aft end 112.

Figure 7B:
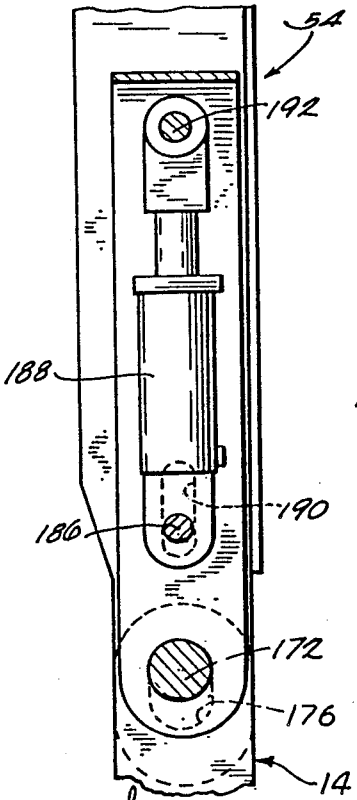
FIG. 7B is a cross-sectional view of the back hitch of FIG. 7A taken along the line 7B—7B in FIG. 7A.
Figure 7A:
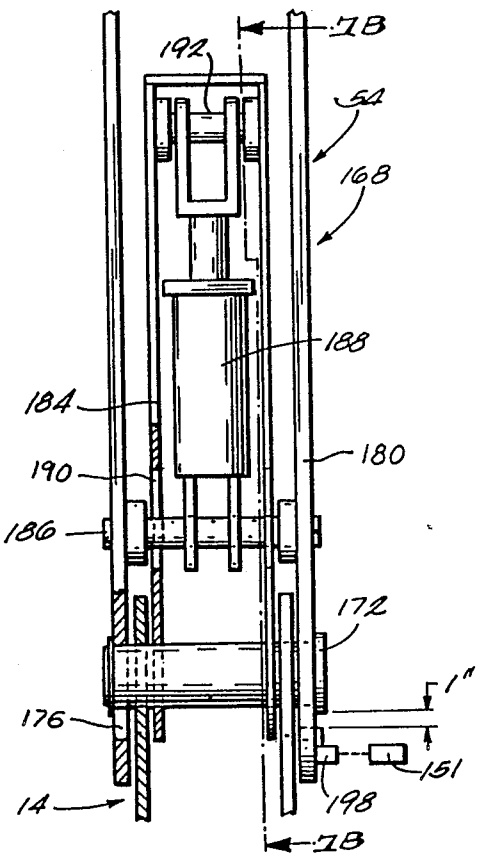
FIG. 7A is a cross-sectional view of a back hitch showing the load sensor.
Figure 11:
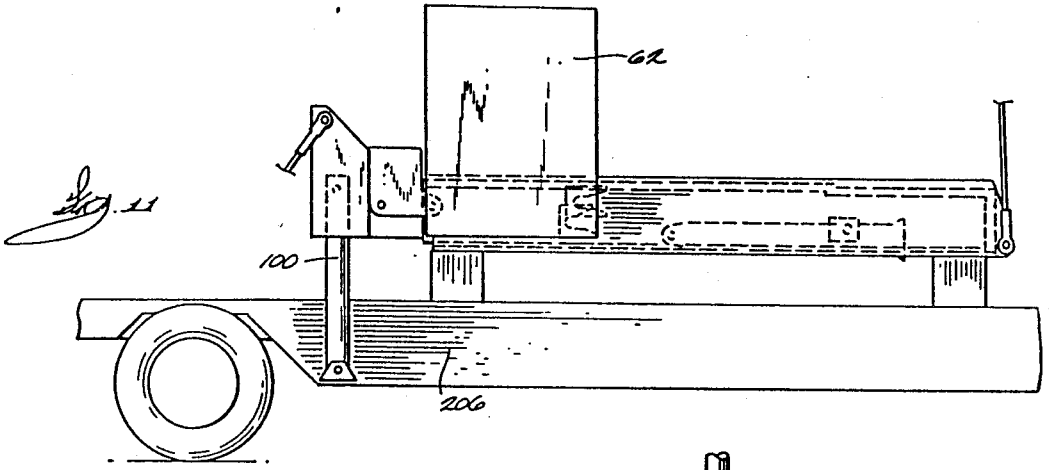
FIG. 11 is a side elevation view of the attachment mounted on the trailer in FIG. 10.

The load is then picked up by the load lifting machinery 66. The carrier cylinder 96 is retracted by the crane operator to a point where a load sensor 168 (described below) in the slotted backhitch 54 causes a cab sensor light (not shown) connected to the sensor 168 to illuminate. Further, in response to a signal from the load sensor 168, the backhitch cylinder 151 is automatically retracted so that the support beam landing gear 100 is now raised from the ground. In other embodiments, the crane operator can manually retract the backhitch cylinder 151 in response to the load sensor signal. The crane operator now may either move the crane 10 along the ground, or rotate the upper works 14 relative to the lower works 22 about the centerline 18 in order to locate the load in a position where it may be set. The load is then set. As the load is set, the load sensor 168 discontinues its signal, causing the backhitch cylinder 151 to automatically extend, pivoting the support beam 84 downward, and setting the landing gear 100 on the ground. The carrier cylinder 96 is then retracted so that the counterweight 62 is moved to the rear of the upper works 14, and the backhitch cylinder 151 is retracted to raise the landing gear 100 from the ground. The machine can now travel to pick up its next load. As illustrated in FIG. 7, the load sensor 168 comprises a pin 172 connected to an innermost member 184 in the backhitch 54. The pin 172 is received in a slot 176 in an outermost member 180 of the backhitch 54. The outer member 180 thus is movable relative to the inner member 184 and pin 172. In the preferred embodiment, the slot 176 permits outermost member 180 to move only one inch relative to the pin 172 in order to prevent undesirable boom drift.

The load sensor 168 also includes means for biasing the backhitch 54 to its retracted position so that the pin 172 is in its uppermost position in the slot 176. The biasing means comprises a damping cylinder 188 located within the inner member 184 and connected between a pin 186 connected to the outer member 180 and a stop 192 within the inner member 184. The inner member 184 has slots 190 through which the pin 186 extends so that the pin 186 is freely movable relative to the inner member 184. The load sensor 168 also includes means responsive to movement of the outer member 180 relative to the inner member 184 for signaling that the movement has occurred. In this embodiment, the signal means is in the form of a switch 198 mounted on the outer member 180 at the bottom of the slot 176, as described below.

The forward end of the mast 42 is pivotally attached to the crane upper works 14. When the crane operator lifts the load, the counterweight 62 located at the beam aft end 112 produces a force moment in excess of the load moment. The mast 42 remains pivoted downwardly, and the outer member 180 remains downward relative to the inner member 184, thereby keeping the load sensor pin 172 in the top of the backhitch slot 176.

When the counterweight 62 is moved forward along the support beam 84, the moment provided by the counterweight 62 eventually equals and then becomes less than the moment provided by the load. The bias of the cylinder 188 operates against the outer member 180 to prevent movement of the outer member slot 176 relative to the pin 172 until after the counterweight 62 has moved past the point where the counterweight moment equals the load moment. As the counterweight 62 moves past the balance point, the mast 42 is pivoted upwardly. This causes the slotted backhitch 54 to become fully extended, which raises the outer member 180 and in turn forces the bottom of the slot 176 and associated switch 198 to engage pin 172, which provides the signal to the load sensing light and the signal to a control (not shown) which in turn retracts the backhitch cylinder 151. When the signal is off, the control extends the backhitch cylinder 151.

After the load is set, the backhitch 54 is retracted by the force of the counterweight 62 on the mast 42, so that the outer member 180 is again forced downward, such that the top of the slot 176 again engages pin 172. As the outer member 180 begins to move, the switch 198 is deactivated, thereby discontinuing the signal, causing the backhitch cylinder 151 to extend, and lowering the beam aft end 112. If the load sensor 168 did not include the biasing means provided by damping cylinder 1.88, the beam aft end 112 might meet the ground as the crane travels over the ground and changes its orientation.

Figure 8:
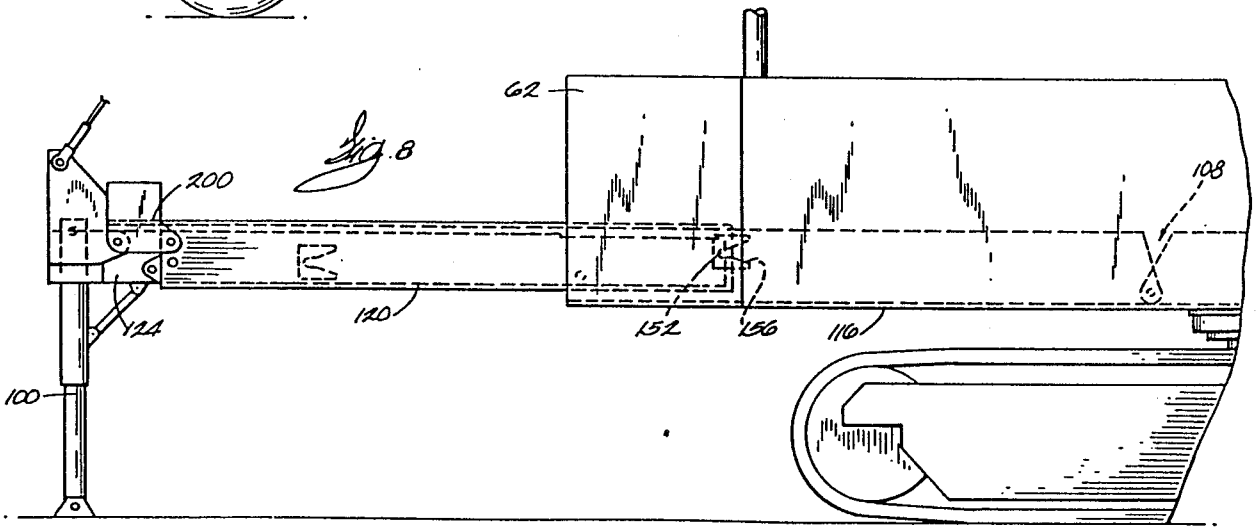
FIG. 8 is a side elevational view of the attachment in a partially extended position.

If desired, only two of the three segments 88 of the support beam 84 may be extended, as illustrated in FIG. 8. In this position, the third segment 124 is pinned to the second segment 120 before it is extended, and the second segment 120 is fully extended relative to the first segment 116, where it is pinned in the manner previously described. One of the segments in the backhitch pendant 149 is then removed in order to shorten the pendant 149. A support beam spacer 200 is normally located below the carrier second piece 95 and attached thereto by locking pins (not shown). At this point, the beam spacer 200 is disconnected from the carrier 92, and is fixed to the beam aft end 112 atop the third segment 124, so the support beam upper surface 128 is flat back to the beam aft end 112. This allows for the use of the attachment 80 with a shorter length in more confined areas where rotating of the crane upper works 14 with the support beam 84 fully extended would be difficult. The shortened attachment 80 is operated in the same manner as previously described.

When the support beam segments 88 are fully extended, the following procedure is used to retract the support beam 84. The counterweight 62 is again pinned to the crane upper works 14, and the support beam landing gear 100 is fully retracted, thereby supporting the attachment at its fore end 108 and at the support shear blocks 136 so that the aft end 112 is held above the ground. The counterweight carrier 92 is then pinned to the beam aft end 112. The backhitch cylinder 151 is retracted to allow removal of the support beam pins, while pressure is maintained by the carrier cylinder 96. After the pins are removed, the backhitch cylinder 151 is further extended to allow slack in the backhitch pendant 149. The carrier cylinder 96 and the backhitch cylinder 151 are then retracted. The attachment 80 is now fully stowed within the crane upper works 14, as illustrated in FIG. 9, and the crane 10 can be used in a conventional manner.

In one embodiment, the support beam lift jacks 100 are mounted on the ends of staggered outriggers 202, as illustrated in FIG. 10. The provision of the landing gear 100 on the outriggers 202 provides a substantial space between the lift jacks through which a trailer 206 may be passed. More particularly, the fore end 108 of the attachment may be raised by suitable equipment, such as the crane 10. The trailer 206 may then be moved under the attachment 80. After the fore end of the attachment 80 is supported on the trailer, the aft end 112 of the attachment is supported in its present position while the outriggers 202 are retracted to where they can now sit atop the trailer 206. This allows for ready movement of the attachment 80, including the counterweight 62, if so desired, from location to location.

Various other features of the invention are set forth in the following claims.

We claim:

1. An attachment for increasing the lifting capacity of a crane where the crane includes a counterweight, a mobile lower works, an upper works mounted on the lower works and including a rear portion adapted to support the counterweight, a pivotally mounted boom having a top, an upwardly projecting mast having a top, means for lifting a load from the top of the boom, rigging means interconnecting the top of the boom and the top of the mast, and means interconnecting the top of the mast and the rear portion of the upper works for opposing a load lifted from the top of the boom;

said attachment comprising:

a counterweight support beam including a plurality of connected segments movable relative to each other, a fore end adapted to be connected to the crane upper works, and an aft end rearward from the rear portion of the upper works, said beam being extendable by moving said connected segments relative to each other between a first position wherein said aft end is spaced from said rear portion of said crane upper works, and a second position wherein said aft end is spaced further from said rear portion of said crane upper works, a counterweight carrier adapted to carry the counterweight when the counterweight is supported on said support beam for movement along the length thereof and over one or more of the connections between said segments, and means for selectively moving said counterweight fore and aft along said beam.

2. An attachment according to claim 1 wherein said support beam comprises a plurality of telescopic segments.

3. An attachment according to claim 2 wherein the outermost of said plurality of telescopic segments is adapted to be pivotally connected to said crane upper works.

4. An attachment according to claim 2 wherein there are three of said segments.

5. An attachment according to claim 2 wherein said support beam has an upper surface, and said carrier is supported by said support upper surface, and wherein some of said plurality of telescopic segments are stepped so that when said plurality of telescopic segments are fully extended, said upper surface of said support beam is essentially flat and said counterweight and carrier can be moved relatively easily along said support upper surface by said carrier moving means.

6. An attachment according to claim 5 wherein, when less than all of said plurality of segments are fully extended, said attachment further includes a beam spacer on said aft end of said beam, behind the last fully extended of said stepped segments.

7. An attachment according to claim 1 wherein said fore end of said support beam is adapted to be pivotally connected to said crane upper works, and said support beam is further adapted to be supported by said crane upper works intermediate said fore and aft ends.

8. An attachment according to claim 1 and further including pivot support means intermediate said support beam fore end and said support beam aft end for selectively providing additional support of said beam on the ground.

9. An attachment according to claim 1 wherein means for moving said counterweight carrier comprises a hydraulic cylinder connected at one end to said fore end of said beam, and at the other end to said carrier.

10. An attachment according to claim 1 and further including means for selectively extending and retracting said support beam.

11. An attachment according to claim 10 wherein said means for moving said counterweight carrier comprises a hydraulic cylinder connected at one end to said fore end of said beam, and at the other end to said carrier.

12. An attachment according to claim 11 wherein said extending and retracting means comprises said carrier moving means, and said carrier moving means is selectively attachable to the support beam aft end.

13. An attachment according to claim 1 wherein the support beam is adapted to be detachably connected to the crane upper works.

14. An attachment according to claim 1 wherein the support beam comprises two spaced parallel members each comprising a plurality of telescopic segments.

15. The attachment according to claim 1 wherein the attachment further comprises:

leg means for supporting said aft end of said beam on the ground, and means for displacing said leg means from the ground incident to lifting a heavy load from the boom.

16. An attachment according to claim 15 wherein said leg means is extendable and retractable.

17. The attachment according to claim 15 wherein the attachment further comprises:

means interconnecting said aft end of said beam and the top of the mast.

18. An attachment according to claim 17 wherein said means interconnecting said beam aft end and said mast top comprises a pendant adapted to be connected to one of said aft end of said support beam and the top of the mast, and wherein said means for displacing said leg means comprises a hydraulic cylinder connected to said pendant and the other of said aft end of said support beam and the top of the mast.

19. An attachment according to claim 18 wherein said pendant is adapted to be connected to said top of said mast.

20. The attachment according to claim 1 wherein the attachment further comprises:

means interconnecting said aft end of said beam and the top of the mast.

21. The attachment according to claim 1 wherein the counterweight support beam is adapted to be retractable to a storage position.

22. A crane including (a) a counterweight;

(b) a mobile lower works;

(c) an upper works mounted on said lower works and including a rear portion adapted to support said counterweight;

(d) a pivotally mounted boom having a top (e) an upwardly projecting mast having a top;

(f) means for lifting a load from said top of said boom;

(g) rigging means interconnecting the top of said boom and the top of said mast;

(h) an attachment comprising:

(i) a counterweight support beam having a fore end adapted to be detachably connected to said crane upper works, and an aft end rearward from the rear portion of said upper works, (ii) a counterweight carrier adapted to carry said counterweight when said counterweight is supported on said support beam for movement along the length thereof, and (iii) means for selectively moving said counterweight fore and aft along said beam; and (i) means interconnecting the top of said mast and the rear portion of said upper works for opposing a load lifted from the top of said boom, said mast top and upper works rear portion interconnecting means including means for sensing when said counterweight has moved to a balanced position where the moment produced by said counterweight about equals the moment produced by a lifted load, said moments being measured about the point where the mast connects to the crane upper works.

23. A crane in accordance with claim 22 wherein said mast top and said upper works rear portion interconnecting means includes a first member connected to one of the mast top and the upper works rear portion, and a second member movable relative to said first member and connected to the other of said mast top and said upper works rear portion, and wherein said sensing means comprises means responsive to movement of said first member relative to said second member for signalling that movement has occurred.

24. A crane in accordance with claim 22 wherein the means interconnecting the top of said mast and the rear portion of said upper works further comprises a biasing means such that in said balanced position the moment produced by the load is slightly greater than the moment produced by the counterweight.

25. A crane in accordance with claim 22 wherein the attachment further comprises:

leg means for supporting said aft end of said beam on the ground, and means for displacing said leg means from the ground incident to lifting a heavy load from the boom.

26. A crane in accordance with claim 25 wherein said crane further includes means for deactivating said leg displacing means when the load is no longer being lifted by the load lifting means.

27. A crane in accordance with claim 25 further including means for operating said leg displacing means in response to said sensing means sensing said balanced position.

28. A crane in accordance with claim 22 wherein the attachment further comprises:

means interconnecting said aft end of said beam and the top of the mast.

29. A crane in accordance with claim 22 wherein said sensing means comprises means for sensing when said means interconnecting the top of said mast and the rear portion of said upper works changes from being in compression to being in tension during movement of the counterweight towards the crane, or changes from being in tension to being in compression during movement of the counterweight away from the crane.

30. The crane according to claim 22 wherein said counterweight support beam includes a plurality of connected segments moveable relative to each other and wherein said counterweight carrier is further adapted to carry the counterweight over one or more of the connections between said segments.

31. A balanced load sensor assembly for use on a crane having a pivotally mounted boom; means for lifting a load from the boom; an upwardly extending mast; a generally rigid backhitch connecting the mast to the crane; a counterweight; rigging means for interconnecting the boom, the mast and the counterweight to oppose tipping moments imposed on the crane by lifted loads; a counterweight support beam and means for selectively moving said counterweight along said counterweight support beam; said balanced load sensor assembly comprising:

(a) a backhitch between the top of the mast and the crane comprising a first member and a second member moveable relative to the first member, said first member being fixedly connected to said crane, said second member being attached to the crane such that said second member would normally move relative to the first member in response to a shift in the counterweight past the balance point where the moment due to the load is about equal to the moment due to the counterweight, said moments being measured about the point where the mast connects to the crane upper works;

(b) means for sensing relative movement between said first and second members; and (c) biasing means connected between the first and second members to prevent said members from moving relative to each other except when the counterweight, when moving toward the crane, moves slightly beyond the balance point.

32. A balanced load sensor assembly according to claim 31 wherein the first member is pinned to the crane by a pin which passes through a slot in the second member, and said means for sensing relative movement comprises a switch fixed to the second member which is activated by the movement of the pin in the slot.

33. A balanced load sensor assembly according to claim 31 wherein the biasing means comprises a hydraulic cylinder.

34. The balanced load sensor assembly of claim 31 wherein said rigging means interconnects with said counterweight by attaching to the counterweight support beam on which said counterweight is supported.

35. A crane with an attachment for increasing the lifting capacity of the crane where the crane includes a counterweight, a mobile lower works, an upper works mounted on the lower works and including a rear portion adapted to support the counterweight, a pivotally mounted boom having a top, an upwardly projecting mast having at top, means for lifting a load from the top of the boom, rigging means interconnecting the top of the boom and the top of the mast, and means interconnecting the top of the mast and the rear portion of the upper works for opposing a load lifted from the top of the boom;

and where the attachment comprises:

a counterweight support beam having a fore end adapted to be connected to a crane upper works and an aft end rearward from the rear portion of the upper works, said aft end being interconnected to the top of said mast, a counterweight carrier adapted to carry the counterweight when the counterweight is supported on said support beam for movement along the length thereof, and means for selectively moving said counterweight fore and aft along said beam;

said attachment being moveable to a storage position in which the aft end of the beam is positioned so that the tail swing of the crane with the attachment connected is minimized.

36. The apparatus according to claim 35 in which the support beam comprises a plurality of telescoping segments and said attachment is moved to said storage position by retracting said telescopic segments.

37. The apparatus according to claim 36 in which the crane upper works is adapted for storage of the retracted support beam within the upper works.

* * * * *

UNITED STATES PATENT AND TRADEMARK OFFICE

CERTIFICATE OF CORRECTION

PATENT NO. : 4,953,722

DATED : September 4, 1990

INVENTOR(S) : Thomas K. Becker et al.

It is certified that error appears in the above-identified patent and that said Letters Patent is hereby corrected as shown below:

In column 2, line 36, please delete "a" and substitute therefor --an--.

In column 4, line 62, after "the" please delete --,--.

In column 4, line 64, after "beam" please insert --,--.

In column 5, line 4, please delete "of" and substitute therefor --or--.

In column 5, line 32, after "could" please delete --,--.

In column 5, line 47, please delete "1B" and substitute therefor --18--.

In column 5, line 54, please delete "supported" and substitute therefor --support--.

In column 7, line 43, please delete "Weight" and substitute therefor --weight--.

UNITED STATES PATENT AND TRADEMARK OFFICE

CERTIFICATE OF CORRECTION

PATENT NO. : 4,953,722

DATED : September 4, 1990

INVENTOR(S) : Thomas K. Becker et al.

It is certified that error appears in the above-identified patent and that said Letters Patent is hereby corrected as shown below:

In column 7, line 44, please delete "Works" and substitute therefor --works--.

In column 8, line 68, please delete "1.88" and substitute therefor --188--.

In column 10, (claim 9) line 58, after "wherein" please insert --said--.

In column 11, (claim 22) line 47, after "top" please insert --;--.

In column 14, (claim 35) line 9, please delete "at" and substitute therefor --a--.

Signed and Sealed this

Third Day of November, 1992

*Attest:*

*Attesting Officer*

DOUGLAS B. COMER

*Acting Commissioner of Patents and Trademarks*